United States Patent [19]

Moorhouse

[11] Patent Number: 4,653,297

[45] Date of Patent: Mar. 31, 1987

[54] INTERIOR BARRIER LOCK STRUCTURE

[76] Inventor: John H. Moorhouse, Clear Lake, Minn. 55319

[21] Appl. No.: 885,749

[22] Filed: Jul. 21, 1986

Related U.S. Application Data

[63] Continuation of Ser. No. 432,786, Oct. 1, 1982, abandoned.

[51] Int. Cl.[4] ..... E05B 27/08

[52] U.S. Cl. ..... 70/363; 70/419

[58] Field of Search ..... 70/363, 378, 389, 419, 70/364 R, 364 A

[56] References Cited

U.S. PATENT DOCUMENTS

| | | | |
|---|---|---|---|
| Re. 28,319 | 1/1975 | Kerr | 70/363 |
| 541,630 | 6/1895 | Ridgway . | |
| 1,619,252 | 3/1927 | George . | |
| 2,618,957 | 11/1952 | Tonnessen | 70/358 |
| 3,380,268 | 4/1968 | Perrill | 70/363 |
| 3,411,331 | 11/1968 | Schlage | 70/363 |
| 3,422,646 | 1/1969 | Monahan | 70/363 |
| 3,648,492 | 3/1972 | Walters et al. | 70/363 |
| 3,728,880 | 4/1973 | Falk | 70/363 |
| 3,738,136 | 6/1973 | Falk | 70/378 X |
| 3,885,409 | 5/1975 | Genakis | 70/419 X |
| 3,903,720 | 9/1975 | Scherbing | 70/363 |
| 3,916,657 | 11/1975 | Steinbach | 70/338 |
| 4,012,931 | 3/1977 | Harunari | 70/363 |
| 4,041,739 | 8/1977 | Mercurio | 70/363 |
| 4,143,530 | 3/1979 | Murtezov et al. | 70/363 X |
| 4,194,378 | 3/1980 | Swindler et al. | 70/363 |
| 4,233,828 | 11/1980 | Dauenbaugh | 70/363 |

*Primary Examiner*—Robert L. Wolfe

*Attorney, Agent, or Firm*—Schroeder & Siegfried

[57] ABSTRACT

A cylindrical tumbler lock including a barrier member between and interfacing a first and second connected latch operating members, the members having corresponding holes receiving spring biased split pin tumblers, a key positioning the tumblers for interfacial clearance between the members for rotation and operation of a latch member, the holes in one of the members being larger, the split tumblers in the holes of the first latch operating member including false segments of the tumblers and the tumblers extending to the face of the lock or some extending near thereto whereby the lock is caused to be very resistant to picking or manipulation.

6 Claims, 11 Drawing Figures

17
16
12b
20
116
114
30
12a
12c
12
24
22
125
37
26
S
79
37a
35
65
34
34a
81-89
90
40
14
22
60a
40b
40a
40c
60
65
10
75
37
34
81
79
12c
16
77
55
17

81
82
83
40c
84
89
12
88
87
86
85
S 40a
60
130
126
40
40e
40c
60a
40b
52
55
51
50
95-103
91
90
93

INTERIOR BARRIER LOCK STRUCTURE

This application is a continuation of application Ser. No. 432,786, filed Oct. 1, 1982 and now abandoned.

BACKGROUND OF THE INVENTION

1. Field of the Invention

This invention relates to a cylindrical pin tumbler lock structure embodying rotatable latch operating members having an intermediate barrier member and embodying key positioned split pin tumblers which include false pin tumbler segments.

2. Description of the Previous Art

Cylindrical locks embodying axially aligned rotatable members accommodating pin tumblers are known in the art.

Various efforts have been made to resist picking or manipulation. Improvement is present in the disclosed structure in embodying structure which includes false pin tumbler segments, non-uniform diameters of the tumblers and tumbler receiving holes, and extending the tumblers to or near to the face of the lock, all of which make picking a lock a very difficult and reduced to chance.

SUMMARY OF THE INVENTION

It is an object of this invention to provide a cylindrical split pin tumblers type of lock in which the structure of the tumbler arrangement causes the lock to be very resistant to picking or manipulation.

More specifically it is an object of this invention to provide a lock structure embodying a forward and a rearward rotatable latch operating member having a barrier member therebetween, said members having corresponding pin tumbler receiving holes, the pin tumblers disposed in the holes of the forward member consisting of uneven length segments some of which are false and which give misleading information as to the true tumbler arrangement for operation of the lock.

It is also an object of this invention to embody the use of pin tumblers extending forwardly to be near to or flush with the face of the lock housing to be effectively resistant to the penetration of adhesive spray material which is commonly used to coat the sides of the tumblers to cause them to remain in a locked open position when the key is withdrawn. Further, it is readily visually determined if the tumblers are not freely moveable to return to their normal positions flush with the face of the lock housing.

Embodied within the invention herein is the concept of including pin tumbler segments having diameters of varying size in the pin tumbler holes of the respective latch operating or barrier members or having the diameter of the pin tumbler holes of one or more of said members vary in size.

Also embodied herein is the concept of having at least some of the pin tumblers bored and corresponding pin tumblers having reduced diameter portions to interfit and a like relationship between the tumblers and the bits of the key to increase the difficulty of someone trying to determine the tumbler construction for attempted unauthorized operation of the lock.

These and other objects and advantages of the invention will be set forth in the following description made in connection with the accompanying drawings in which like reference characters refer to similar parts throughout the several views.

DESCRIPTION OF A PREFERRED EMBODIMENT

Figure 1:
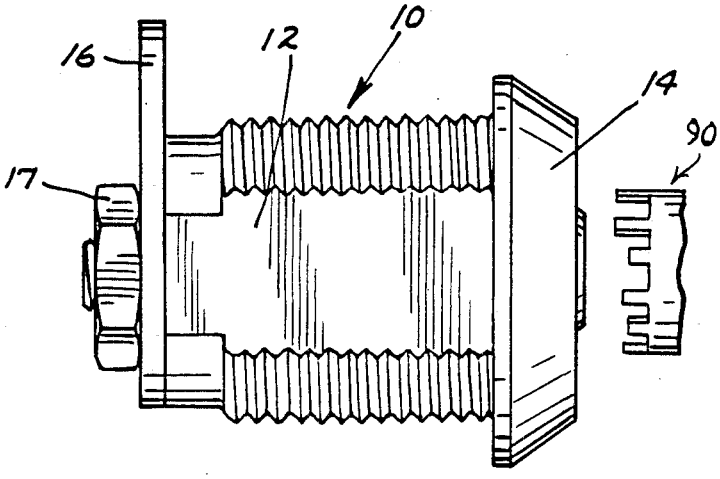
FIGS. 1 and 2 are respectively side and front elevational views.
Figure 2:
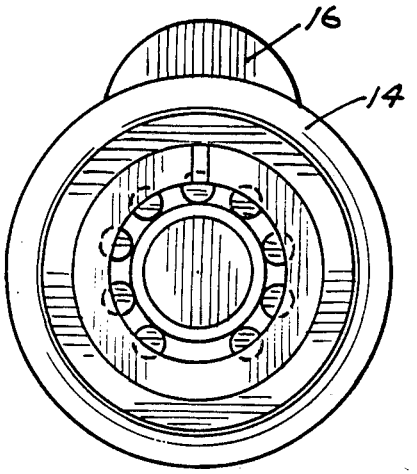
Figure 3:
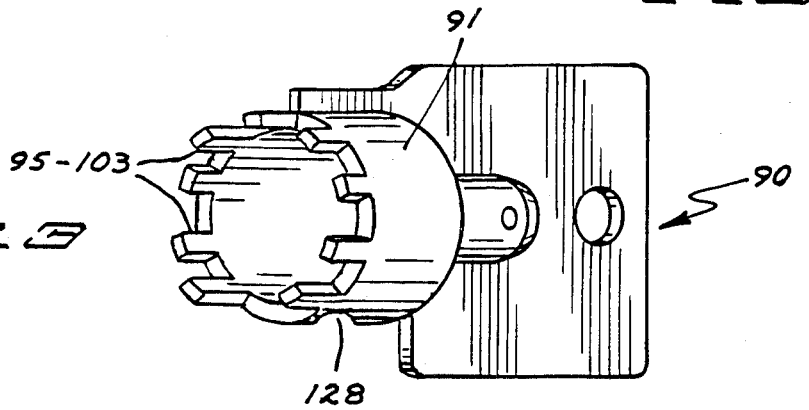
FIG. 3 is a view in perspective of a key structure.

Referring to FIG. 1 of the drawings, a cylindrical lock structure 10 is shown having a uniform central body portion 12, an annular beveled flange portion 14 at the face portion thereof and at the rearward end thereof a latching member 16 secured by a nut 17, to be further described.

Figures 5, 6, 7:
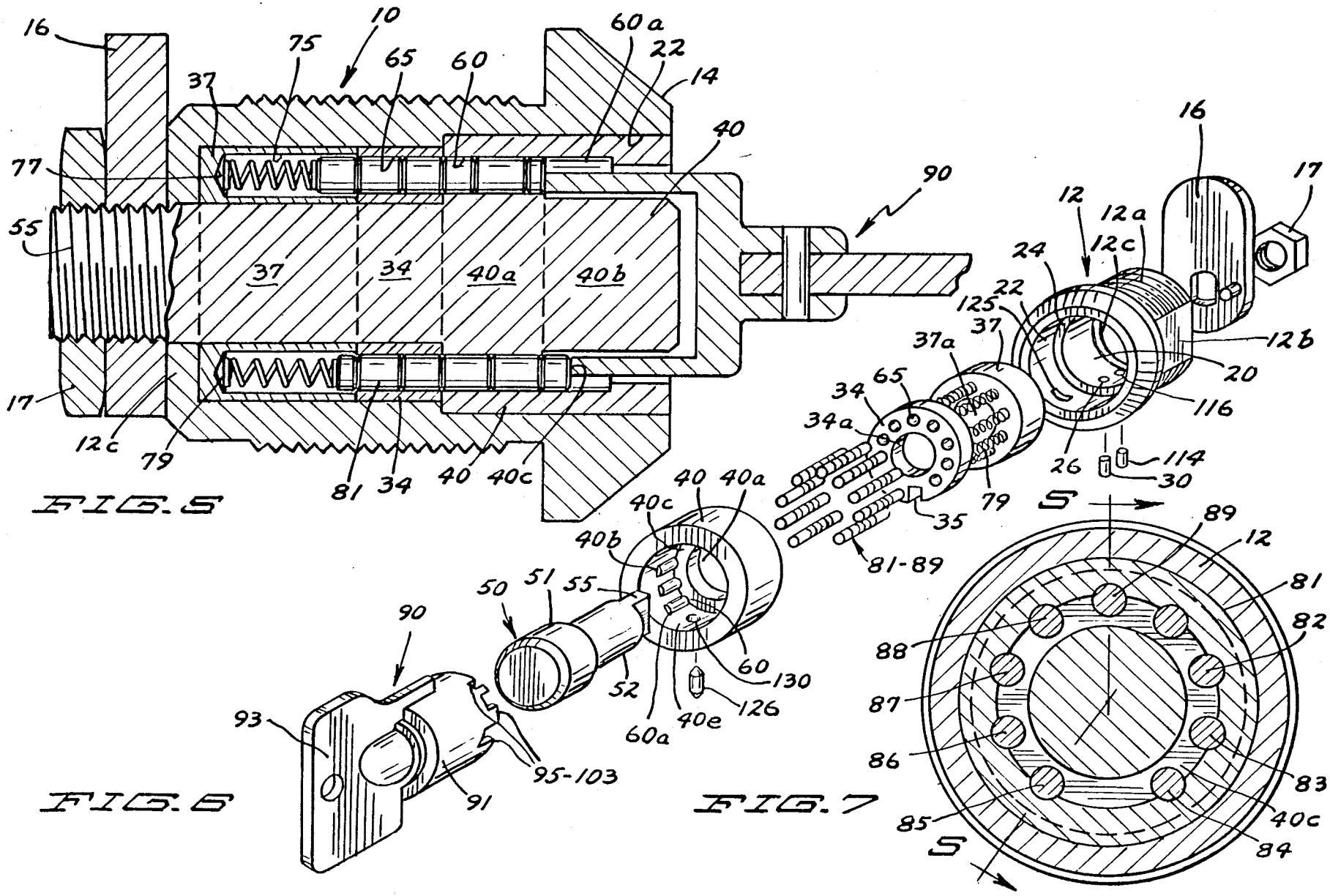
FIG. 5 is a view similar to FIG. 4 taken on line 5—5 of FIG. 7 and showing another operating position.
FIG. 6 is an exploded view in perspective.
FIG. 7 is a view in section taken on line 7—7 of FIG. 4.

Referring particularly to the exploded perspective view of FIG. 6, the housing 12 has a bore 20 in the rearward portion thereof and a counter bore 22 in the forward portion thereof forming a shoulder 24 therebetween. The housing 12 as illustrated has rounded top and bottom portions **12*a* and flat side wall portions 12*b***.

Disposed within said bore 20 flush with the shoulder 24 is a cylindrical or ring like barrier member 34 having a slot 35 in the bottom thereof as seated in said housing and disposed into said slot through a hole 26 in the bottom wall of said housing is a pin 30 to hold said barrier member in a non-rotating position.

Also disposed into said bore 20 rearwardly of said barrier member 34 and engaging the same in an abutting or interfacial relationship is a rotatable cylindrical core or plug member 37, the same being retained within said bore by the inwardly extending annular flange **12*c* forming the rear wall of said housing 12**.

Disposed within said counter bore 22 in an abutting or interfacial relationship with said member 34 is a cylindrical rotatable core or plug member 40 which bears against the shoulder 24.

The members 34, 37 and 40 have axially aligned uniform bores **37*a*, 34*a* and 40*a*** extending therethrough.

The member 40 has a counter bore **40*b* in the forward portion thereof forming a shoulder 40*c* with the bore 40*a***.

A connecting member 50 comprises a cylindrical elongated pin like member having a forward end portion 51 which seats within the counter bore **40*b* and is spaced radially therefrom as at 41 to accommodate the key 90 (to be described) therebetween. Said connecting member has an extended cylindrical portion 52 of reduced diameter with a threaded end portion 55 extending through the bores 40*a* and 37*a* and through the bore 20 and on through the end wall 12*c* of the housing 12 having secured thereon said latching member 16 by said locking nut 17**.

The barrier member 34 has a plurality of circularly spaced axially aligned holes aligned holes 65 therethrough, said holes being substantially equally spaced about said bore 34*a* therein. Nine holes are shown for purpose of illustration.

The plug member 40 has extending through the shoulder 40*c* thereof a plurality of holes 60 corresponding to the holes 65. Said holes 60 extend into the bore 40*b* of said member 40 and forwardly thereof into the forward wall portion 40*e*, said extended portions of said holes as at 60*a* are semi-cylindrical in form as illustrated.

The plug member 37 has a plurality of holes or cavities 75 therein corresponding to the holes 65 of the member 34 but having a somewhat larger diameter. Said holes as shown in FIG. 5 have rear end walls 77. Disposed within said holes 75 to bias the pin tumblers to be described are coil springs 79.

Adapted to extend within the holes 60, 65 and 75 are cylindrical pin like tumbler members or tumblers which for purpose of illustration are indicated here as 81–89. As with the pin tumbler 81, as a representative example, said pin tumblers are split into longitudinal segments such as 81*a*–81*f*, each of said segments preferably being non-uniform in length and the segments of one pin tumbler preferably being non-uniform with regard to the corresponding segments of another.

A key 90 is provided to operate said lock 10, said key comprising a hollow cylindrical forwardly projecting portion 91 having bittings 95–103 therein, these being known in the art and may be of various recessed or projecting extent and extending rearwardly thereof is a blade handle portion 93.

The bittings 95–103 and the pin tumblers 81–89 are arranged and constructed to correspond that when said key is inserted into said counter bore 40*b* into the radial space or key way 41 and disposed about the end portion 51 of the plug connecting member 50 and said bittings 95–103 engage the adjacent end portions of the corresponding pin tumblers in the holes 60 and move them forwardly against the biasing action of the springs 79, said pin tumblers will be moved axially or lengthwise to have complete segments thereof contained within the plug member 40, within the barrier member 34 and within the plug member 37 whereby there is no interfacial obstruction by said pin tumblers of either plug member 40 or 37 with the barrier member 34 and the key rotates said plug members 40 and 37 to operate the latch 16. This is referred to as interfacial clearance for operation of the lock.

Figure 8:
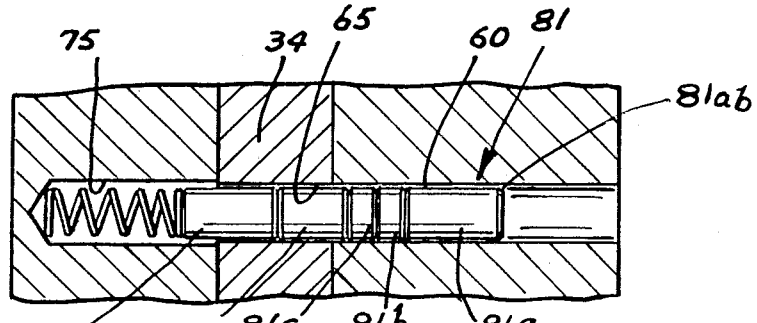
FIG. 8 is a view in side elevation showing a detail of structure in one operating position.

The segments of the pin tumblers 81–89 have adjacent end rounded or beveled edges as illustrated at 81*ab* in FIG. 8 whereby said segments are readily moveable between the holes of the plug members without inadvertently being blocked by engagement with an edge portion of a hole as could be the case with a squared end.

The portions of the pin tumblers (FIG. 8) which extend into the holes 60 are here shown to be non-uniform in length. The tumbler segments 81*a, b, c* include two false tumbler segments which for illustration will be indicated to be 81*a* and 81*c*. These are representative as to concept and do not indicate a particular dimension. A lock picker or manipulator would have to ascertain the length of all three segments to determine a lock opening relationship with the segments in the holes 65 and 75. The false segments desirably will vary in each of the holes of the plug 40. The chances are that the lock picker will select one or two of the first three segments to determine the bittings for his unauthorized key and will fail in his picking attempt. The length of time required in this effort is a very discouraging factor for the picker.

Two false segments in each of nine pin tumblers require selecting one of three tumbler segment portions to ascertain for each of the nine tumblers which make the chances of selecting the valid tumbler segments $3^9$ or one chance in 19,683 attempts. With a lock designed for nine bitting intervals or nine tumbler engaging positions in the key, for further example, with each pin tumbler having six segments and using nine tumblers, there are $6^9$ key combinations for a total of 10,077,696 combinations. Key combinations are distinguished from picking combinations. The key combinations indicate the very desirable commercial feasibility of the lock.

Figure 4:
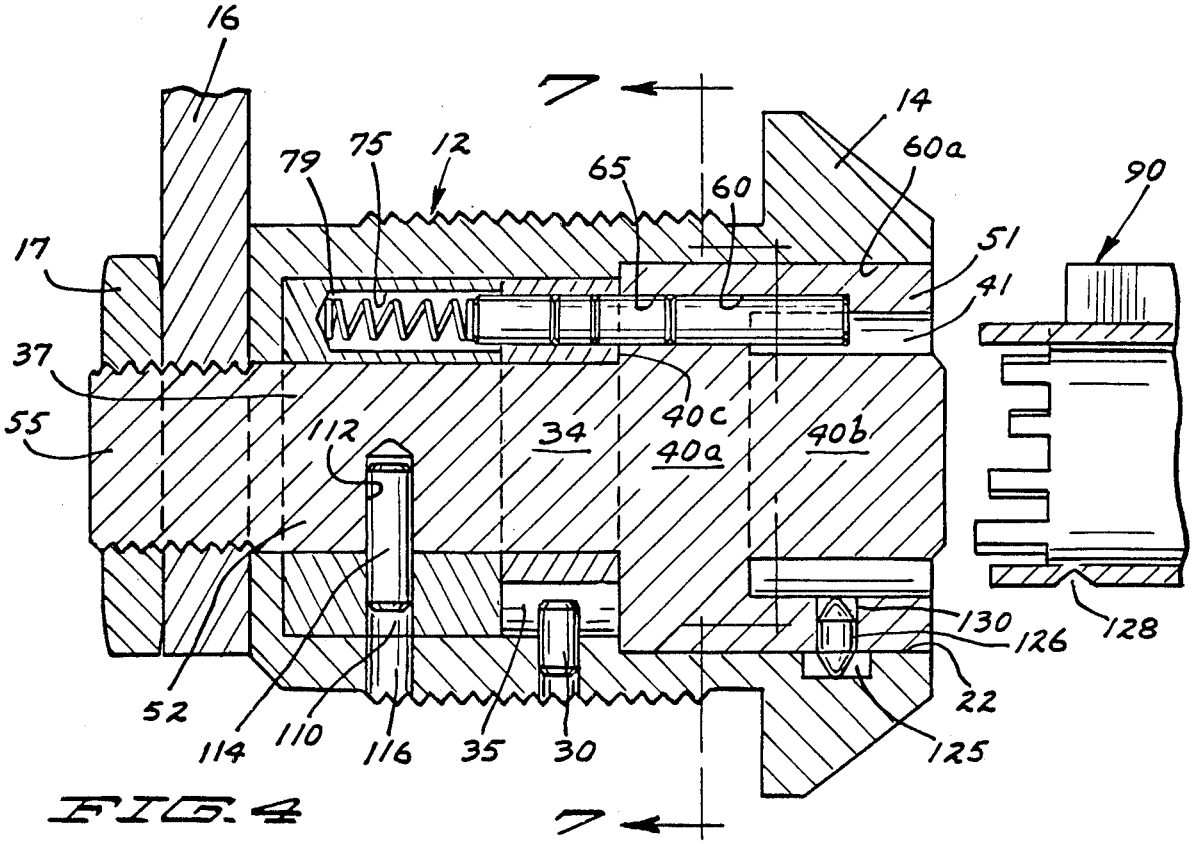
FIG. 4 is a view in vertical longitudinal section showing one operating position.

The view of FIG. 4 shows the structure herein in assembled order prior to the insertion of a key and in FIG. 5 is shown the assembled lock structure with the key 90 inserted and the pin tumblers positioned for interfacial clearance between the plug members 40–34 and 34–37. Further, FIG. 4 shows structure to retain the key in operating position. A hole 110 is shown in the wall of the plug member 37 and a corresponding hole 112 is shown in the shaft 52 of the connecting member 50 with a pin 114 disposed therein for an operative connection of the plug members 40 and 37 by the member 50. An access hole 116 is provided in the housing 12. Further, a cammed recess 125 is shown formed into the bottom of the counter bore 22 having a pin 126 disposed therein; said pin preferably has tapered ends as shown, said pin extends upwardly into the hole 130 upwardly through the bottom wall of the plug member 40.

Said key 90 has a tapered recess 128 formed into the bottom wall thereof to receive the adjacent portion of the pin 126.

With the insertion of said key into operating position, the key rotates the plug member 40 causing lateral movement of the pin 126 and the same is moved out of its cammed recess upwardly through the hole 130 and into the recess 128 of said key and thus the key with any lateral or rotative movement thereof is locked into the plug member and thus is prevented from being withdrawn except for being in the start position.

In an effort to pick a lock, torque will generally be applied in an effort to operate the lock and to ascertain the length of the tumblers to position the segments as not to obstruct the interfacial separations between the 40–34 and 34–37. The application of torque will misalign the holes or cavities 60 and 75 relative to the holes or cavities 65 and as will be described will cause the tumbler segments in the holes 60 and 65 which obstruct the interfacial plane between the members 40 and 34 to be caught and held in a scissor action as will be described.

Figure 9:
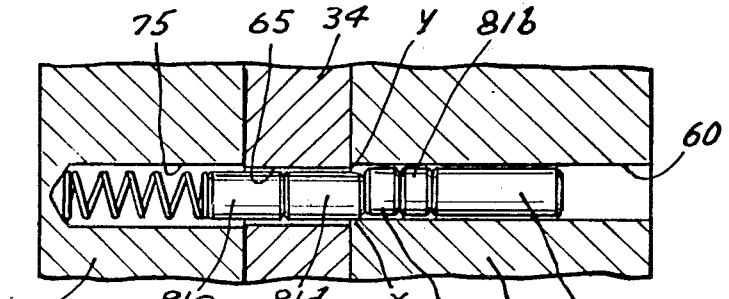
FIG. 9 is a view similar to that of FIG. 8 showing a modification of a detail of an operating position.

Described now will be a lock picking effort and the resistance of the structure herein to such an effort. With the application of torque, (FIG. 9), the bore of the hole 60 will move against the obstructing portion of the segment 81*c* as at the point X and the segment will be moved through the clearance space of the hole 65 into engagement with the bore of the hole 60 at the point Y in what may be termed a scissor action and exerting a shearing action. The lock picker will insert a picking tool into the keyway 41 engaging the tumbler 81*a* and will cause the segment 81*c* to bear against the adjacent end of 81*d*. The picker will next attempt to ascertain the length of each segment by locating their respective ends or the splits between them. With two of the segments being false segments, the lock picker will have to ascertain which combination of segments in the holes 60 will cause the lock to operate. This means ascertaining the right combination of segments or the right for each of nine tumblers.

It is possible to have an interfacial clearance between the members 40 and 34 but not between the members 34 and 37 for one or more of the tumblers. The hole 75 is larger than the hole 65. Hence with clearance between the plug members 40 and 34, presuming this possibility, but not between 34 and 37, further rotation of the member 40 will misalign the holes 75 and 65 sufficiently to block any segment from being forced into a hole 75 in the event the shearing action on the segment 81*e* in any of the holes 75 is overcome.

The difficulty of ascertaining the segment structures of each of the nine tumblers with the element of chance involved is so time consuming and difficult as to serve as a substantial and very effective barrier against lock picking.

MODIFICATION

Figure 10:
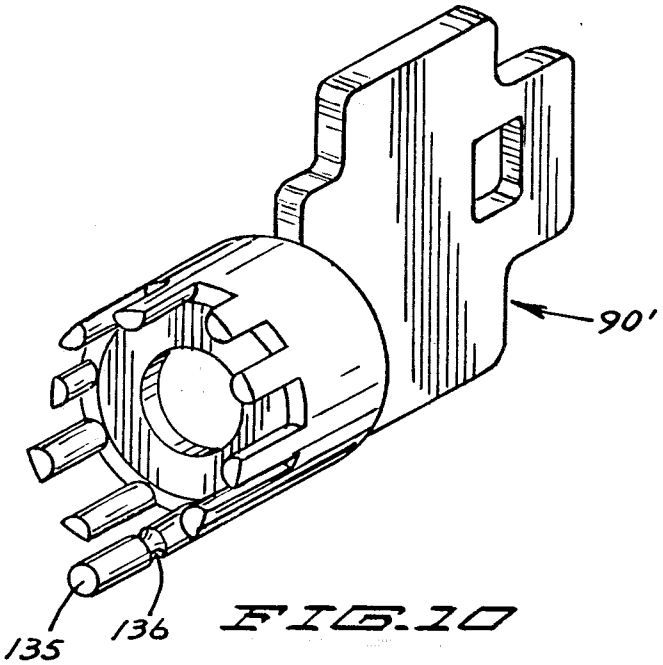
FIG. 10 is a view in perspective showing a modified key structure.
Figure 11:
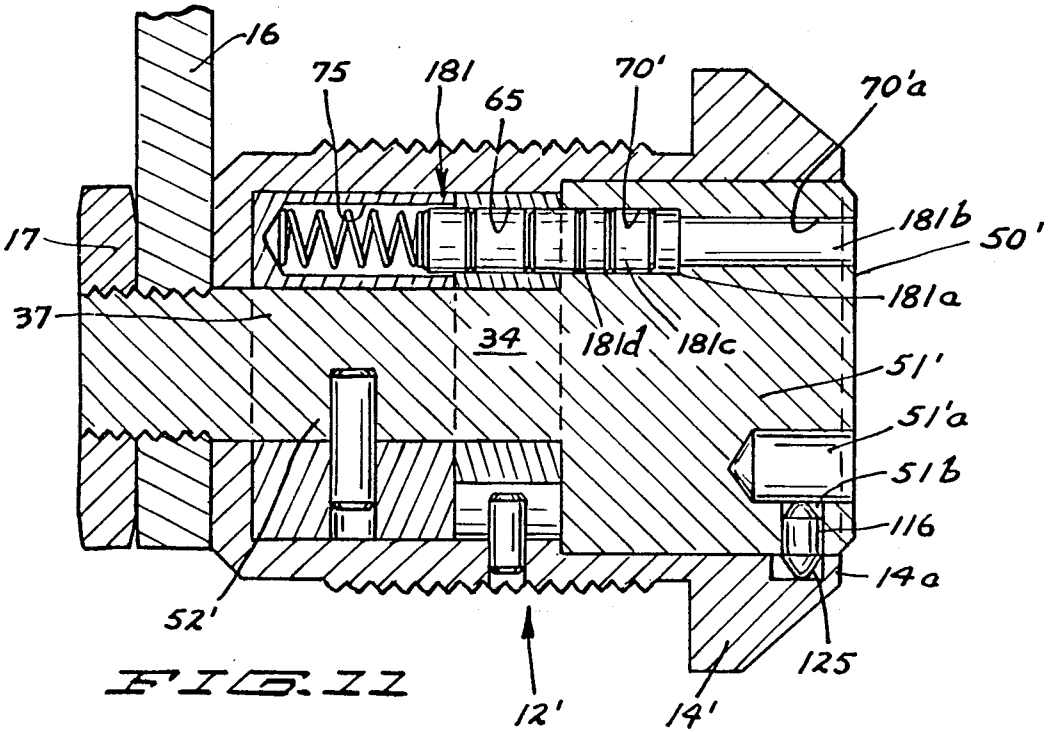
FIG. 11 is a view in longitudinal vertical section similar to that of FIG. 4 showing a modification.

With reference to FIGS. 10 and 11, a modification is shown of the structure hereinabove described in which like reference numerals indicate like elements or members and a prime added indicates a modification of such members or elements.

With particular reference to FIG. 11, in lieu of the rotatable plug member 40 as above described, the connecting member 50 here indicated as 50' has a head portion 51' which is substantially the same size in outer diameter as the plug member 40 and is a substitute for the same, the remainder 52' thereof is as above described in connection with the member 50.

For purpose of illustration and not for purpose of limitation, the head portion 51' has formed therein the holes 70' which will be concentric respectively with and in alignment with the holes 65 and 75 of the plug members 34 and 37. The holes 70' have forward extending portions 70'*a* of reduced diameter which extend to be substantially flush with the face of said member 51' and of the face 14*a* of the housing member 12'.

Pin tumbler 181 is shown in lieu of the previously described tumblers 81–89 and representative of a corresponding number of tumblers in which the forward or leading segment of each of the tumblers as illustrated, has a portion 181*a* disposed in and conforming to the diameter of the hole 70' with an extended portion 181*b* thereof of reduced diameter extending to be substantially flush with the face of said member 51' and with the outer face 14*a* of the housing 12'.

The pin tumbler 181 by way of illustration and representative of the others comprises a like number of segments such as shown with the pin tumblers 81–89 and of which the forward segment 181 has been above described. Three segments are shown within the hole 70' and these are 181*a, c, d* and of these segments preferably two segments are false segments and the length of the hole portion 70'*a* may vary with respect to the remaining like holes extending through said head portion 51'.

The key 90 above described is here shown in modified form as 90' having bittings corresponding to those above described and having in addition a cylindrical projection 135 having intermediate thereof an annular V-shape groove 136.

Said head member 51' in addition to having said holes 70' therein, also has a cylindrical recess 51'*a* to receive the key projection 135. Said head portion 51' has at its bottom a hole 51'*b* to receive therein pin 116 whereby when said key is rotated to operate the lock, said pin 116 is moved outwardly from its cammed recess 125 to enter the groove 136 and thus prevents the withdrawal of the key from any but its starting position.

A salient feature of having the pin tumblers extend to the outer face of the lock housing is that this structure makes it very resistant to penetration along the pin tumbler side walls of any adhesive spray which would be intended to cause the tumblers to remain fixed in a latch opening position in which they would be placed by the operation of a key.

Further upon removal of the key, it is readily ascertainable visually whether the pin tumblers have returned to their fully outwardly extending position to be flush with the outer face of the housing.

The operator of this structure is as with the structure first described herein.

The use of false tumbler segments makes it extremely difficult in attempting to pick a lock to ascertain the segments which are false and misleading in an effort to achieve interfacial clearance between the barrier member and the plug member at each end thereof. As previously noted, in view of the mathematical odds against finding the working key operating combination, it is very unlikely that the lock would be picked.

The modification as described would visually indicate whether any attempt has been made to cause the tumblers to be stuck in a lock opening position.

Thus, the structure herein described is regarded as representing a significant advance in the art of creating lock structures which are fairly pick proof.

It will of course be understood that various changes may be made in form, details, arrangement and proportions of the parts without departing from the scope of the invention herein which, generally stated, consists in an apparatus capable of carrying out the objects above set forth, in the parts and combinations of parts disclosed and defined in the appended claims.

What is claimed is:

1. A tumbler lock structure embodying a pair of rotatable plug members operatively associated with a stationary barrier member therebetween, each accommodating tumblers in combination comprising:

a housing member, a forward and a rearward rotatable plug member disposed in said housing member, a barrier member disposed between said plug members and having interfacial contact therewith, operative means operatively communicating with said plug members, a plurality of cavities axially aligned with and circularly disposed within said plug and barrier members, said cavity diameter in one of said plug members or of said barrier member being larger than of the other, a latching member at the rear of said housing member carried by said operative means, a plurality of pin tumbler members each comprising a plurality of split segments respectively disposed in said cavities, and engaging said plug and barrier members, said pin tumbler members disposed within said forward plug member and having at least three segments, said segments being of unequal length, and at least two of said segments bearing no relation to an operative positioning of said pin tumblers, biasing means communicating with said rearward plug member biasing said tumbler members, and a key engaging said tumbler members to dispose said tumbler members for interfacial separation of said plug members and said barrier member whereby said plug members and said latching member are operated.

2. The structure of claim 1, wherein the diameter of said holes in at least one of said plug members and said barrier members being larger than the holes in the remaining plug members or said barrier member.

3. The structure of claim 1, wherein said forward plug member has an annular internal shoulder therein and a forward bore portion of reduced diameter, said holes in said forward plug member extend through said shoulder and into the wall of said forward bore portion forming semi-cylindrical holes in said forward bore portion.

4. A tumbler lock structure, having in combination:

a cylindrical housing member, a forward and a rearward rotatable plug member disposed in said housing member and defining a common axis of rotation, a stationary barrier member between said plug members, means operatively connecting said plug members, a plurality of corresponding holes extending through and circularly disposed about, said axis of said plug and barrier members, said holes of one of said plug members or of said barrier member having a larger diameter than of the other, pin tumbler members disposed in said holes having split segments of non-uniform length, at least three segments of each of said pin tumbler members extending into the holes of said forward plug member, at least one of said segments of each of said pin tumblers in said last mentioned plug member being a false segment bearing no relation to an operative positioning of said segments of said respective pin tumblers, biasing means communicating with said rearward plug members biasing said pin tumbler members, a latch member rearward of said housing member carried by said operative means, a key member including bittings engaging said pin tumblers in said forward plug member, and bittings of said key member being respectively adapted to position said tumblers in said holes to cause an interfacial separation between said barrier member and said plug members for unitary rotation of said plug members and of said latch member.

5. The structure set forth in claim 4, wherein said holes of at least one of said plug members being non-uniform with respect to the holes in the other of said plug members.

6. The structure set forth in claim 4, wherein the holes of at least one of said plug members or said barrier member having a diameter larger than the holes in the remaining plug members or said barrier member.

* * * * *

UNITED STATES PATENT AND TRADEMARK OFFICE

CERTIFICATE OF CORRECTION

PATENT NO. : 4,653,297

DATED : MARCH 31, 1987

INVENTOR(S) : JOHN H. MOORHOUSE

It is certified that error appears in the above-identified patent and that said Letters Patent is hereby corrected as shown below:

Column 5, line 60, insert --not-- ahead of the word "vary".

Fig. 5, please amend drawing as shown per attached sheet.

Signed and Sealed this

Twenty-ninth Day of December, 1987

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,653,297

DATED : MARCH 31, 1987

INVENTOR(S) : JOHN H. MOORHOUSE

It is certified that error appears in the above-identified patent and that said Letters Patent is hereby corrected as shown below:

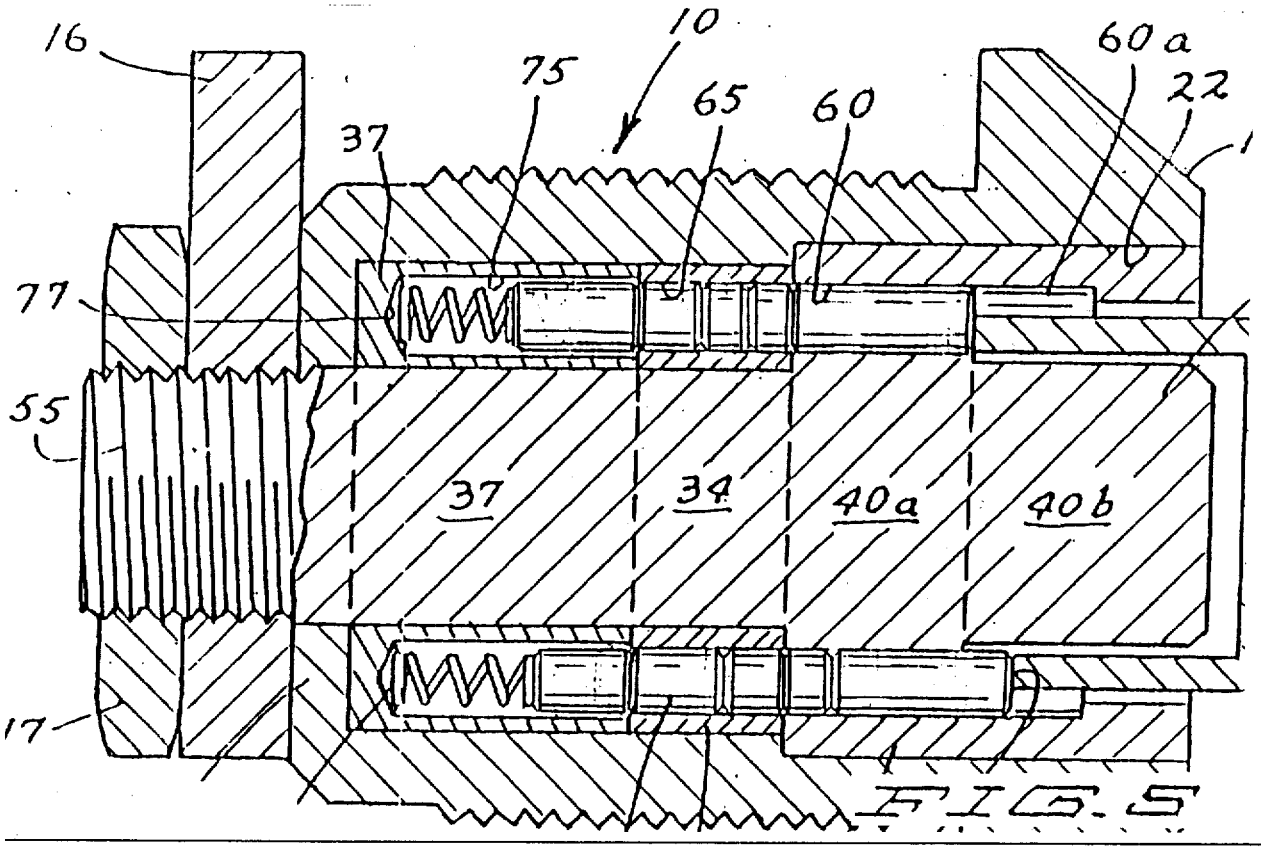

FIG. 5

UNITED STATES PATENT AND TRADEMARK OFFICE

CERTIFICATE OF CORRECTION

PATENT NO. : 4,653,297

DATED : MARCH 31, 1987

INVENTOR(S) : JOHN H. MOORHOUSE

It is certified that error appears in the above-identified patent and that said Letters Patent is hereby corrected as shown below:

IN THE DRAWINGS

Fig. 6, please amend drawing as shown hereinbelow.

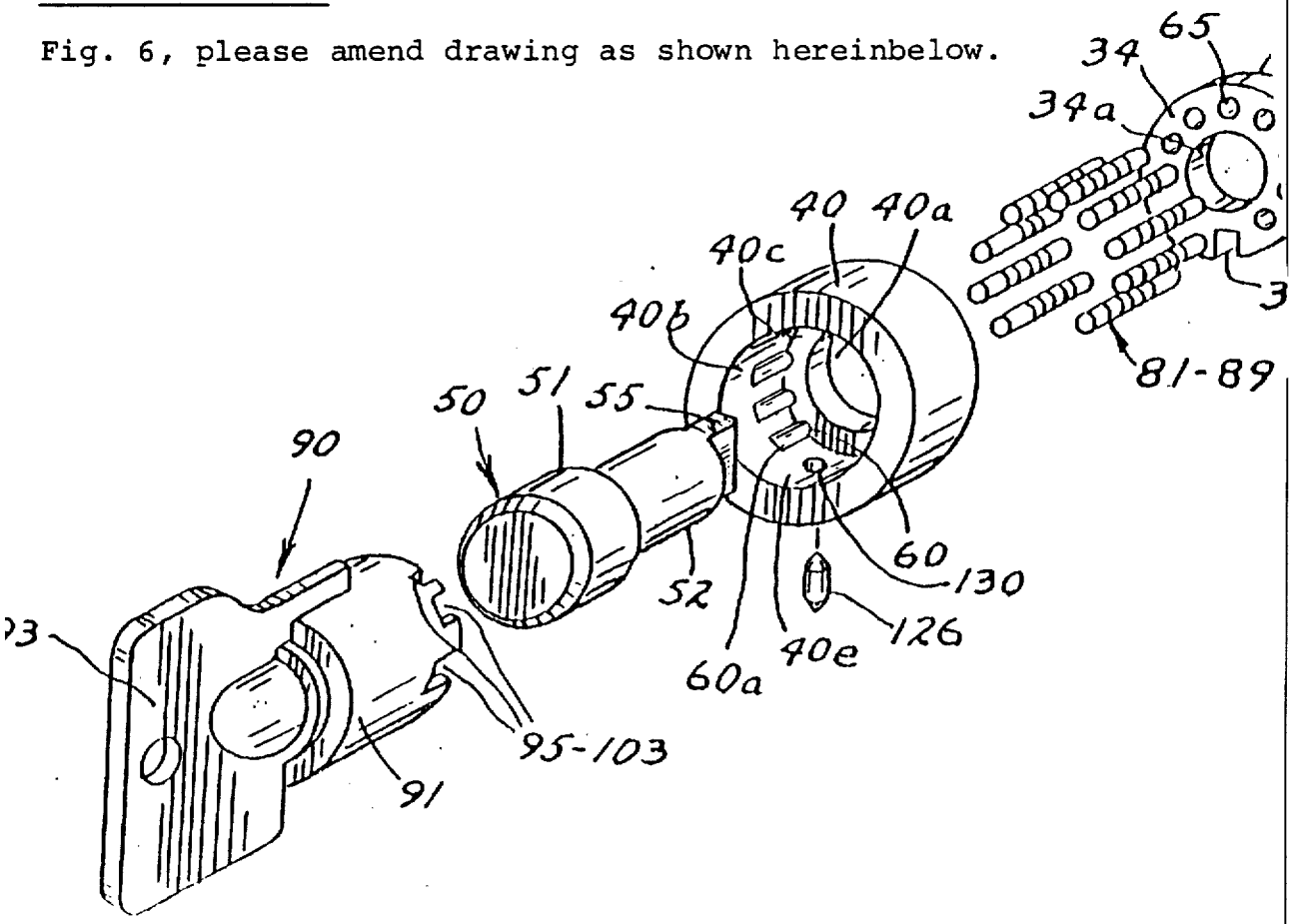

FIG. 6

UNITED STATES PATENT AND TRADEMARK OFFICE

CERTIFICATE OF CORRECTION

PATENT NO. : 4,653,297

DATED : MARCH 31, 1987

INVENTOR(S) : JOHN H. MOORHOUSE

It is certified that error appears in the above-identified patent and that said Letters Patent is hereby corrected as shown below:

IN THE DRAWINGS

Fig. 8, please amend drawing as shown hereinbelow.

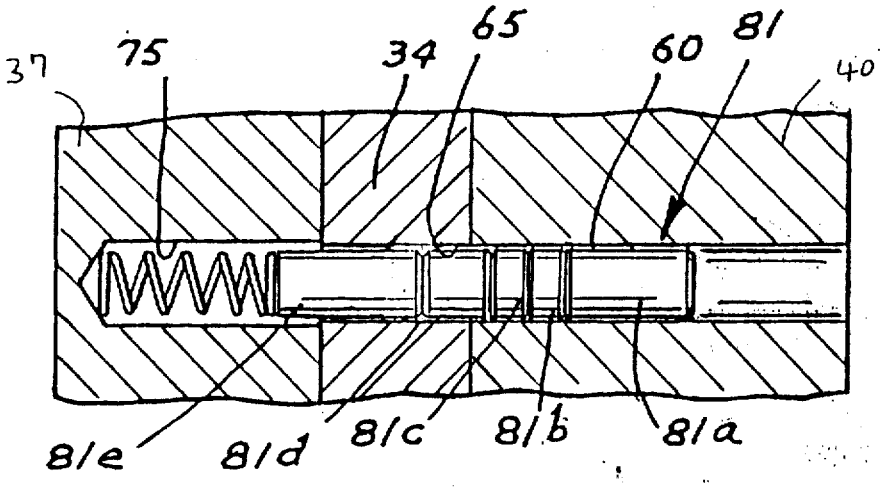

FIG. 8